United States Patent [19]

Simpson

[11] Patent Number: 4,791,870

[45] Date of Patent: Dec. 20, 1988

[54] PYROTECHNIC ASSEMBLY

[75] Inventor: Geoffrey M. Simpson, Nottingham, United Kingdom

[73] Assignee: Haley & Weller Limited, Draycott, England

[21] Appl. No.: 633,266

[22] Filed: Apr. 4, 1984

[30] Foreign Application Priority Data

Apr. 5, 1983 [GB] United Kingdom ..... 8309218

[51] Int. Cl.[4] ..... F42B 4/26

[52] U.S. Cl. ..... 102/342; 102/351; 102/352; 102/357

[58] Field of Search ..... 102/338, 340, 351, 352, 102/357, 342

[56] References Cited

U.S. PATENT DOCUMENTS

| | | | |
|---|---|---|---|
| 2,785,632 | 5/1957 | Clauser et al. | 102/340 |
| 4,130,059 | 12/1978 | Block et al. | 102/351 |
| 4,307,665 | 12/1981 | Block et al. | 102/357 X |
| 4,374,494 | 2/1983 | Maury | 102/351 X |
| 4,498,392 | 2/1985 | Billard et al. | 102/357 X |
| 4,505,202 | 3/1985 | Fidler et al. | 102/357 X |
| 4,549,489 | 10/1985 | Billard et al. | 102/357 X |

FOREIGN PATENT DOCUMENTS

| | | | |
|---|---|---|---|
| 1314811 | 4/1973 | United Kingdom | 102/341 |

*Primary Examiner*—Peter A. Nelson
*Attorney, Agent, or Firm*—William R. Hinds

[57] ABSTRACT

A pyrotechnic assembly has an outer container for a plurality of pyrotechnic elements, each of which has a propellant charge, to propel the element out of the container, and a pyrotechnic charge, for example for producing a radiation-blocking screen. The container may be used as a fixed launcher for the elements or may itself be a projectile or missile from which the elements are ejected in flight. A plurality of different pyrotechnic charges may be included in the element.

9 Claims, 2 Drawing Sheets

PYROTECHNIC ASSEMBLY

This invention relates to a pyrotechnic assembly for use, for example, in projecting a series of individual pyrotechnic elements, preferably at predetermined time intervals.

According to the invention, a pryotechnic assembly comprises an outer tubular launching tube sealed at one end with an end cover, and a plurality of pyrotechnic elements mounted in a stack formation therein, each element having a main pyrotechnic charge and having apropellant charge positioned between itself and the next element to propel the element out of the one end of the tube, each element including a pyrotechnic delay charge for igniting its propellant charge whereby the propellant charges are ignited at predetermined intervals, and each element including a further pyrotechnic delay charge to delay the ignition of the main pyrotechnic charge until a predetermined time after ignition of its propellant charge. The pyrotechnic charges may be of a plurality of different formulations. Preferably the pyrotechnic charges comprise charges of a pyrotechnic composition for producing a radiation-blocking screen, and more preferably, at least one of the pyrotechnic charges is a charge other than for producing a radiation-blocking screen, for example a decoy flare for heat-seeking missiles or the like, or a charge of metal foil which may be used to provide misleading radar echoes and to reduce the effectiveness of laser range-finding and projectile or missile guidance devices.

The tube preferably includes an ejection charge which can be ignited, when all the elements have been propelled out of the tube, to eject the tube from a conventional grenade launching tube of an armoured vehicle, for example, used to fire the assembly.

In addition to being used in grenade launching tubes, mortars and the like, where the assembly remains in the tube or mortar until the elements have been ejected, the assembly of the invention may be adapted for use as a projectile or missile itself, the individual elements being expelled in sequence during flight of the assembly. In this way, screens may be created at predetermined altitudes above the ground.

The assembly of the invention may be used to project a plurality of different pyrotechnic, devices to obtain a combination of different effects from a single source.

Figure 1:
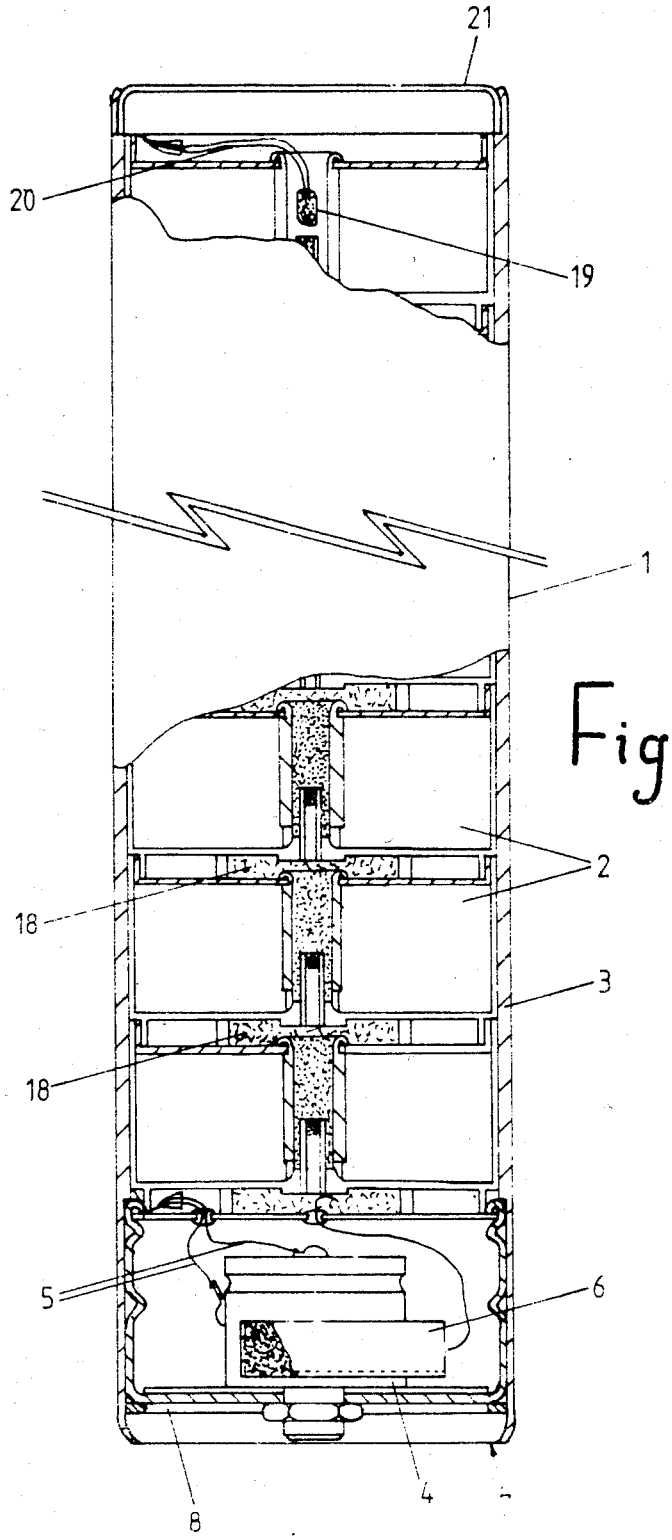
Figure 2:
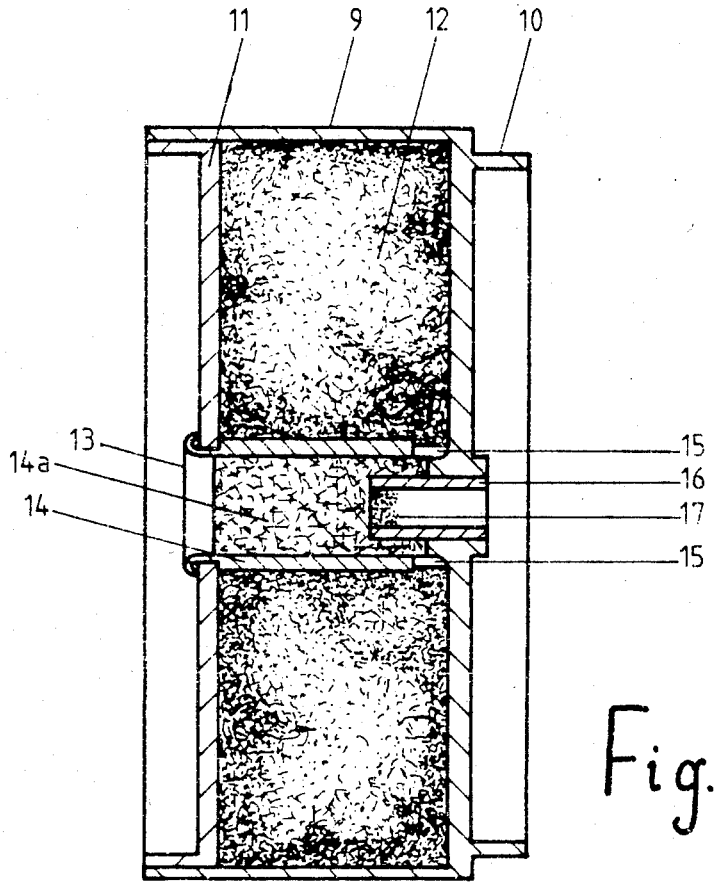

Reference is made to the drawings, in which:

FIG. 1 is a partially sectioned view of an assembly in accordance with one embodiment of the invention; and FIG. 2 is a section through a pyrotechnic element forming part of the assembly of FIG. 1.

The pyrotechnic assembly 1 comprises a plurality of pyrotechnic elements 2 enclosed within an outer cylindrical container 3. The container 3 is formed of aluminium and has at one end an electrical connecting socket 4 adapted to receive a connecting plug in the base of a grenade launching tube. Launching tubes of this type are well-known in the art and will not therefore be described here in detail.

The socket 4 is connected electrically via wires 5 to thin film conductors on the inner surface of the container. An explosiveejection charge 6 partially surrounds the socket 4, the adjacent end 7 of the container having openings 8 initially covered with burstable aluminium foil covers, to permit the gases produced by ignition of the charge 6 to drive the container out of the launching tube.

The pyrotechnicelements 2 extend within the container in a stack, and an individual element 2 will be described with particular reference to FIG. 2. The element comprises a moulded plastics body 9 in the form of a cup having a base flange 10 adapted to be received in the closure cap 11 of the adjacent element below.

The body 9 contains an annular pyrotechnic charge 12 and a central delay fuse assembly 13 comprising an isolating tube 14 which opens through the cap 11 and terminates adjacent the base of the body 9 with radial apertures 15 opening into the pyrotechnic charge 12. The isolating tube 14 contains a timing charge **14*a*. An igniter tube 16 extends through the base of the body 9 into the tube 14. The igniter tube 16 contains an ignition charge 17 at the upper end thereof, which end is at a level above the apertures 15, the distance between the end of the tube 16 and the apertures 15 determning the delay between the element being expelled from the container and the pyrotechnic charge 12** being ignited.

Referring to FIG. 1, a propellant charge 18 is disposed beneath the base of each element 2, the igniter tube 16 being in communication with this propellant charge. The uppermost element contains in place of a part of the timing charge **14*a* an electric igniter 19 connected by wires 20** to the thin film conductors on the inner surface of the container.

In use, an electric firing current passes via the connector socket 4 to the electric igniter 19. This igniter 19 ignites the ignition charge 17 in the uppermost element and also ignites the timing charge **14*a* surrounding the igniter tube 16. The tube 16 transmits the ignition to the propellant charge 18 of the uppermost element 2 which ignites to propel the element out of the container, displacing the end closure 21 of the container. During flight, after a predetermined delay, the timing charge 14*a* burns through and ignites the pyrotechnic charge 12 bursting the plastics body 9** and expelling the contents.

The detonation of the propellant charge 18 ignites the timing charge **14*a* of the next element, and when this charge 14*a* has burnt down to the level of the igniter tube 15, this next element 2 is propelled out of the container. This process continues until all the elements 2 have been expelled from the container. It will be appreciated that by selecting appropriate materials, and quantities of materials for the timing charge 14*a* the intervals at which elements 2** are propelled out of the container may be controlled.

The pyrotechnic charges 12 may be varied to give a variety of different effects, such as smokes and flares.

I claim:

1. A pyrotechnic assembly comprising an outer tubular launching tube sealed at one end with an end cover, and a plurality of pyrotechnic elements mounted in a stack formation therein, each element having a main pyrotechnic charge and having a propellant charge positioned between itself and the next element to propel the element out of the one end of the tube, wherein each element includes a pyrotechnic delay charge for igniting its propellant charge whereby the propellant charges are ignited at predetermined intervals, and wherein each element includes a further pyrotechnic delay charge to delay the ignition of the main pyrotechnic charge until a predetermined time after ignition of its propellant charge.

2. A pyrotechnic assembly according to claim 1, characterised in that the main pyrotechnic charges are of a plurality of different formulations.

3. A pyrotechnic assembly according to claim 2, characterised in that the main pyrotechnic charges comprises charges of a pyrotechnic composition for producing a radiation-blocking screen.

4. A pyrotechnic assembly according to claim 1, characterised in that at least one of the main pyrotechnic charges is a charge other than for producing a radiation-blocking screen.

5. A pyrotechnic assembly according to claim 4, characterised in that at least one of the main pyrotechnic charges is a decoy flare for heat-seeking missiles or the like.

6. A pyrotechnic assembly according to claim 4, characterised in that at least one of the main pyrotechnic charges is arranged to disperse pieces of metal foil.

7. A pyrotechnic assembly according to claim 1, characterised in that the tube includes an ejection charge which can be ignited to eject the container, when spent, from the place of firing.

8. A pyrotechnic assembly according to claim 1, characterised in that the assembly is adapted for use as a projectile or missile from which the pyrotechnic elements may be ejected in sequence during flight of the assembly.

9. A pyrotechnic assembly as claimed in claim 1 wherein each element has end walls and a side wall enclosing said main pyrotechnic charge, an isolating tube extending from and through the end wall which is relatively toward said one end and to the other end wall, said isolating tube being apertured at a predetermined distance along its length so as to communicate its interior with the surrounding main pyrotechnic charge, an ignition tube extending from said propellant charge through said other end wall and into said isolating tube for a predetermined distance beyond said apertures, and a timing delay charge in said isolating tube from its one end to said apertures and surrounding said ignition tube, whereby the timing delay charge from the one end of said isolating tube to the near end of said ignition tube comprises said pyrotechnica delay charge for igniting said propellant charge, and the timing delay charge from the near end of the ignition tube to the apertures in the isolation charge comprises said further delay charge for delaying the ignition of the main pyrotechnic charge until a predetermined time after ignition of the propellant charge.

* * * * *